US006267505B1

(12) United States Patent
Henson

(10) Patent No.: US 6,267,505 B1
(45) Date of Patent: Jul. 31, 2001

(54) SEALABLE SECURITY BAG

(75) Inventor: Trevor Bernard Nigel Henson, Burnley (GB)

(73) Assignee: Learoyd Packaging Ltd., Lancashire (GB)

( * ) Notice: Subject to any disclaimer, the term of this patent is extended or adjusted under 35 U.S.C. 154(b) by 0 days.

(21) Appl. No.: 09/246,817

(22) Filed: Feb. 8, 1999

(30) Foreign Application Priority Data

Feb. 5, 1999 (GB) ..... 9902634

(51) Int. Cl.[7] ..... B65D 33/34
(52) U.S. Cl. ..... 383/5; 383/84
(58) Field of Search ..... 383/5, 78, 93, 383/84

(56) References Cited

U.S. PATENT DOCUMENTS

| | | | | |
|---|---|---|---|---|
| 2,819,010 | * | 1/1958 | Amiguet | 383/93 |
| 3,895,755 | | 7/1975 | McCarthy . | |
| 4,834,552 | * | 5/1989 | Makowka | 383/5 |
| 4,998,666 | * | 3/1991 | Ewan | 383/5 X |
| 5,108,194 | * | 4/1992 | Raden | 383/5 |
| 5,318,364 | * | 6/1994 | Raden | 383/5 |
| 5,350,238 | * | 9/1994 | Bolton | 383/5 |
| 5,631,068 | * | 5/1997 | Smith | 428/195 |
| 5,798,169 | * | 8/1998 | Smith | 383/5 X |
| 5,918,983 | * | 7/1999 | Palazzolo | 383/5 |

FOREIGN PATENT DOCUMENTS

| | | | | |
|---|---|---|---|---|
| 386919 | | 1/1965 | (CH) . | |
| 0 373 748 | * | 6/1990 | (EP) | 383/5 |
| 0 657 363 | | 6/1995 | (EP) . | |
| 0 805 018 | | 5/1997 | (EP) . | |
| 1271284 | | 7/1961 | (FR) . | |
| 1282964 | | 12/1961 | (FR) . | |
| 1215888 | * | 12/1970 | (GB) | 383/5 |
| 2264281 | * | 12/1970 | (GB) | 383/5 |
| 1536784 | * | 12/1978 | (GB) | 383/78 |
| 2 225 311 | * | 5/1990 | (GB) | 383/5 |
| 2243143 | * | 10/1991 | (GB) | 383/5 |
| 2270857 | * | 3/1994 | (GB) | 383/5 |
| 2 278 594 | * | 12/1994 | (GB) | 383/5 |
| 2 314 830 | | 1/1998 | (GB) . | |
| 2 320 487 | | 6/1998 | (GB) . | |
| 2 327 933 | | 2/1999 | (GB) . | |
| 2 331 256 | | 5/1999 | (GB) . | |
| 07271302 | | 10/1995 | (JP) . | |
| 91/04199 | * | 4/1991 | (WO) | 383/5 |
| 93/00269 | * | 1/1993 | (WO) | 383/5 |

* cited by examiner

*Primary Examiner*—Jes F. Pascua
(74) *Attorney, Agent, or Firm*—Perman & Green, LLP

(57) ABSTRACT

A tamper-evident seal comprising: a first seal member having an adhesive surface region; a second seal member having a sealing surface region located for adhesion to the adhesive surface region; at least one of the adhesive surface region and the sealing surface region being at least partially coated with a heat-sensitive layer so that when the adhesive surface region is adhered to the sealing surface region the heat-sensitive layer is sealed between the first seal member and the second seal member for providing evidence of thermal tampering.

25 Claims, 1 Drawing Sheet

SEALABLE SECURITY BAG

BACKGROUND OF THE INVENTION

The present invention relates to sealable security bags and in particular to providing secure evidence of thermal tampering with a seal.

Tamper-evident sealable security bags are used for storing and transporting valuable goods such as money. The valuables can be sealed into the bag. When the bag comes to be opened the tamper-evident features of the bag indicate to the recipient whether the sealing of the bag has been tampered with. If the tamper-evident features are intact then they give the recipient confidence that the bag's contents have not been interfered with. The recipient can then cut the bag open.

Security bags typically have an enclosed main body formed of sturdy plastics sheet—for example of polythene or polypropylene. The main body has an opening and a flap that can be folded over the opening on to the main body of the bag to close the opening, Either the flap or the area of the main body of the bag which will be in contact with the flap is coated with strong adhesive which, once stuck, provides a strong bond. The strong adhesive and the sturdy plastic sheet make it difficult, but not impossible, for the bag to be opened illegitimately. However, the bag is provided with tamper-evident security features that aim to provide evidence of an attempt to open the bag illegitimately.

One known way to open such a bag illegitimately is to heat the adhesive of the seal to a temperature at which it becomes plastic, but at which the plastics sheet material of which the body of the bag is made is still stable. This temperature is normally above at least 70° C., depending on the adhesive used. At those temperatures the adhesive becomes sufficiently plastic that the bag can be opened, the contents inspected or removed, and then the bag shut. Without any suitable tamper-evident features it would not then be obvious to the recipient that tampering of this sort had occurred. It would thus be impossible to know, for example, if confidential information in the bag had been seen by a third party or to identify where in a supply chain removal of goods from the bag had occurred.

One tamper-evident feature that is known for providing evidence of such thermal tampering is a detailed pattern printed on the outer surface of the flap of the bag, for example by ink-jet printing. When the seal area is heated and the flap comprised from the body of the bag the resultant stretching of the flap becomes evident as a deformation in the detailed pattern. However, it has been argued that because there may potentially be little stretching (since the material of the bag may remain stable at the temperature at which the adhesive softens) R can be difficult for inexperienced users to notice deformation of the pattern.

Another tamper-evident feature that is known for providing evidence of such thermal tampering is a coating on the outer surface of the flap of a heat-sensitive water-based ink. When the seal area is heated the heat-sensitive ink irreversibly changes colour, clearly indicating that the bag has been tampered with. However, because the ink is water-based it can be wiped off the flap to give the appearance that no tampering has occurred.

It would be desirable to provide a seal suitable, for example, for a security bag which addresses the problem of providing obvious and secure evidence of tampering by heating.

SUMMARY OF THE INVENTION

According to one aspect of the present invention there is provided a tamper-evident seal comprising: a first seal member having an adhesive surface region; a second seal member having a sealing surface region located for adhesion to the adhesive surface region, at least one of the adhesive surface region and the sealing surface region being at least partially coated with a heat-sensitive layer so that when the adhesive surface region is adhered to the sealing surface region the heat-sensitive layer is sealed between the first seal member and the second seal member for providing evidence of thermal tampering.

Preferably the adhesive surface region and/or the sealing surface region is light transmissive, most preferably to allow the said evidence of thermal tampering to be observed therethrough.

The said at least one of the adhesive surface region and the sealing surface region that is at least partially coated with the heat-sensitive layer may be at least partially coated with an absorbent layer such as a matt ink beneath the heat-sensitive layer. Preferably the absorbent layer is the same colour as the at least one of the adhesive surface region and the sealing surface region on which it is at least partially coated.

The heat-sensitive layer may be in the form of a pattern or symbols. The heat-sensitive layer is suitably the same colour as the at least one of the adhesive surface region and the sealing surface region on which it is at least partially coated, and/or the same colour as any underlying absorbent layer. The said evidence of thermal tampering is suitably provided by a change in the heat-sensitive layer, such as a change in colour of that layer. The change suitably occurs at a lower temperature than the temperature at which the adhesive or the seal members thermally deteriorate under heating. The change suitably occurs in the range from 50 to 100° C., most preferably in the range from 70 to 95° C.

The adhesive surface region may be provided by one or more hot melt glues.

Preferably at least one of the adhesive surface region and the sealing surface region is at least partially coated with a cold-sensitive layer so that when the adhesive surface region is adhered to the sealing surface region the cold-sensitive layer is sealed between the first seal member and the second seal member for providing evidence of thermal tampering. The cold-sensitive layer may be a release layer. The cold-sensitive layer is preferably coated on the one of the adhesive surface region and the sealing surface region that is not coated with the heat-sensitive layer.

The seal may be incorporated into a bag, preferably a security bag. The seal is preferably arranged at the opening of the bag to allow the opening to be sealed shut. The opening may be closeable by a flap, suitably a flexible flap. The flap may be welded to the body of the bag. Thus, one of the first or second members may be a flap disposed at the opening of the bag.

At least one of the members suitably comprises or is made of plastics material.

According to the second aspect of the present invention there is provided a bag comprising: a first sheet member and a second sheet member together defining a bag opening therebetween; a flap bonded to the first sheet member at the opening; a flap engagement member bonded to the second sheet member at the opening; and a security seal comprising a tamper-evident structure borne by the flap or the engagement member and an adhesive structure borne by the other of the flap and the engagement member for adhering the flap to the engagement member to close the opening.

The flap engagement member is suitably formed of a flexible sheet The flap engagement member is suitably of an elongate form, most preferably disposed along one jaw of the opening. The flap engagement member may be in the form of a flap. The flap and the flap engagement member are preferably located and/or configured so that they may be mutually engaged to close the opening, suitably with the adhesive structure adhered directly to the tamper-evident structure. The adhesive structure and/or the tamper-evident structure may take the form of coatings comprising one or more layers.

The flap is suitably welded to the first sheet member. The flap engagement member is suitably welded to the second sheet member. The one of the flap and the engagement member that bears the tamper-evident structure may be of a different material from the one of the first and second members to which it is bonded.

The first sheet member may be bonded to the second sheet member to define the bag opening.

The tamper-evident structure is suitably a temperature-sensitive structure for example a heat- and/or cold-sensitive structure. The tamper-evident structure could comprise a temperature-sensitive ink and/or a temperature-sensitive release layer.

According to the present invention from a third aspect there is provided a method for forming a bag, comprising: forming a bag body from a first sheet member and a second sheet member to define a bag opening therebetween; forming a first seal body bearing an adhesive structure; forming a second seal body bearing a tamper-evident structure; bonding one of the first and second seal bodies to the first sheet member at the opening to form a flap; and bonding the other of the first and second seal bodies to the second sheet member at the opening so that the first seal body and the second seal body may be adhered together to close the opening.

Other preferred features of each aspect of the invention include those set out above in relation to the other aspects of the invention.

BRIEF DESCRIPTION OF THE DRAWINGS

The present invention will now be described by way of example with reference to the accompanying drawings, in which.

DETAILED DESCRIPTION OF THE PREFERRED EMBODIMENT

Figure 1:
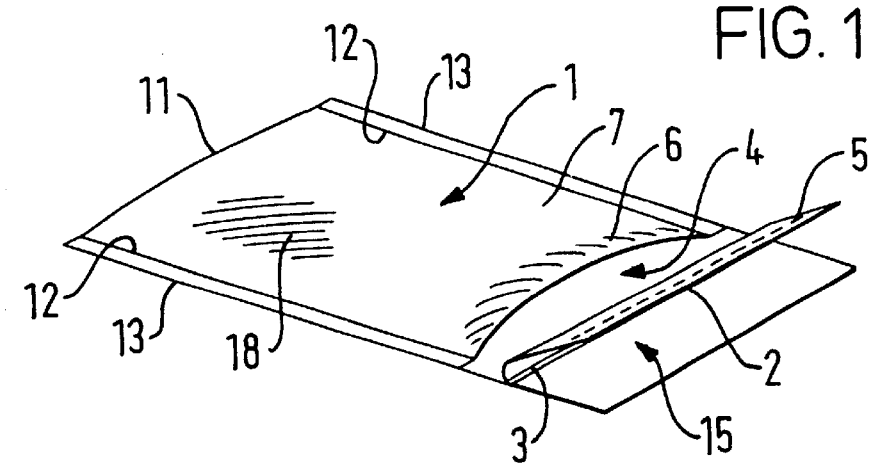
FIG. 1 shows a security bag.

The bag of FIG. 1 has a main body 1 and a flap 2 welded to the main body by a header weld 3. The main body and the flap are formed from heavy-gauge flexible polythene sheet. The flap can be folded from the disengaged position (as illustrated in FIG. 1) to an engaged position in which it closes the opening 4 of the bag. In the engaged position the adhesive region 5 of the flap is engaged over a corresponding sealing region 6 on the outer surface of the upper layer 7 of the bag.

Figure 2:
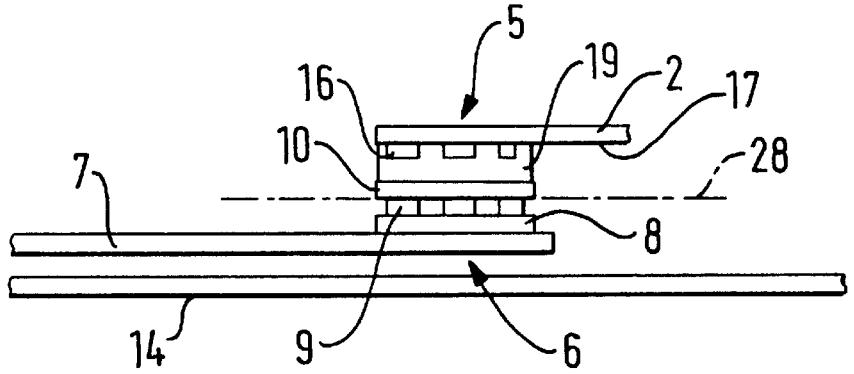
FIG. 2 shows a schematic cross-section through the seal area of the bag of FIG. 1 with the flap of the bag sealed into place over the opening of the bag.

FIG. 2 shows the structure of the bag's seal when the flap has been adhered to the upper surface of the bag. Chain-dotted line 28 indicates the boundary between the layers originally borne by the flap and those originally borne by the upper layer 7 of the bag. In part of the sealing region 6 where, from the geometry of the bag, the flap is expected to be adhered there is a patterned layer of heat-sensitive ink 9. The heat-sensitive ink is capable of irreversibly changing colour on exposure to heat above a certain temperature. When the flap of the bag has been sealed in place, as illustrated in FIG. 2, by adhesive layer 10 borne by the flap the heat-sensitive ink is sealed between the flap 2 and the upper layer of the bag. If there is an attempt to heat-soften the adhesive the heat-sensitive ink 9 will change colour. Because the heat-sensitive ink is sealed between the flap 2 and the upper layer of the bag it cannot be straightforwardly wiped off.

The structure of the bag will now be described in more detail.

The bag is formed from a sheet that is folded at the base 11 of the bag to define the upper layer 7 and lower layer 14 and double welded at 12 and 13 for extra security along the bag's sides. The lower layer 14 extends beyond the upper layer 7 to define a header area 15 of the bag on to which the flap 2 is welded by means of header weld 3. Before sealing, the flap 2 lies naturally over the header area 15 by virtue of the configuration of the weld 3. This keeps the flap 2 out of the way of the opening 4 when the bag is being filled.

During manufacture the flap 2 is coated first with a layer 16 of a release coat material which lies immediately against the inner surface 17 of the flap. The release coat material is cold-sensitive, and is patterned into the words "VOID VOID VOID . . . ". Over the release coat is a layer 19 of semi-opaque green ink. Over the green ink is the adhesive layer 10. The adhesive is a thermal adhesive. When the flap is adhered on to the sealing region 6 this structure provides evidence of thermal tampering at reduced temperatures. The release coat is a material that becomes unstable at a temperature above that at which the adhesive 10 becomes brittle. As the temperature of the seal region is reduced from room temperature the release coat therefore shatters before the adhesive has become sufficiently rigid to allow the seal to be broken. When the release coat shatters, the areas of the ink 19 that underlie the release coat become disrupted from those that remain directly adhered to the lower surface 17 of the flap. As a result the void marking becomes obviously visible through the translucent polythene of the flap 2.

During manufacture the adhesive layer is covered with a removable strip. The strip protects the adhesive layer before use and prevents it from hindering the insertion of articles into the bag. When the bag is to be sealed the strip is torn off to expose the adhesive. The flap 2 may be cut from a pre-formed tape carrying the layers 16, 19, 10 and the removable strip, and welded in place at the opening of the bag.

The sheet that is to form the ba g is first printed with any desired surface pattern, such as markings to indicate the manufacturer of the bag. This printing is done using conventional organic solvent based inks. Then at least part of the sealing region 6 is printed with a matt franking ink 8 such as LRD293 available from ink Tech. This is a highly absorbent matt ink with a high concentration of calcium carbonate and relatively few waxes. Such an ink adheres well even to relatively non-absorbent surfaces such as that of the polythene sheet 7 and is also capable of absorbing solvents such as water so that it is firmly receptive to water-based inks. Over the franking ink is a patterned layer 9 of a heat-sensitive ink such as Black 6766G available from Luminescence, Inc. or CFBK90 chemithermal flexible ink available from Forest inks. Such an ink reacts to change colour permanently on exposure to heat above a certain temperature. Inks having different colour transition temperatures are available. For this application the ink should be selected to have a transition temperature that is sufficiently high to avoid it changing colour during normal use or storage but that is below both the temperature at which the chosen adhesive 10 begins to soften and the temperature at which the chosen sheet 2, 7, 14 begins to soften. Suitable transition temperatures for compatibility with typical bag materials are in the range from 50° C. to 95° C. Inks having transition temperatures outside this range could be suitable for less typical applications.

The adhesive 10 is a hot melt adhesive. The adhesive layer could be a composite layer comprising more than one adhesive so as to extend the temperature range over which the seal is secure, as described in GB 2,320,487 A, the contents of which are incorporated herein by reference.

A number of measures may be taken to increase the visual impact of the heat-sensitive ink once it has transformed under the influence of heat. It is preferred that the material of the upper and lower layers 7, 14 of the bag and/or the material of the flap and the layers borne by it are transparent, translucent or generally light-transmissive so that the colour of the heat-sensitive ink can be observed easily through one or more of them. The flap and/or the upper surface of the bag could be marked near the seal area to draw attention to the need to check the state of the heat-sensitive ink; a notice such as "check for tampering" could be displayed there. The heat-sensitive ink could be chosen so that its colour before transformation is the same as or close to that of the background (the upper layer 7 of the bag and, if present, the matt ink 8) and/or so that its colour after transformation contrasts strongly with that of the background. For example if the upper layer 7 of the bag is white then the combination of Ink Tech's LRD293, which is white, and Forest Inks' CFBK90, which is white before transformation and black after, is highly effective.

The matt ink may be applied to other regions of the outer surface of the bag (e.g. region 18 in FIG. 1) to make it easier to write securely on the bag and, for example, indicate its contents or destination.

The bag may be equipped with other security features such as encoded numbering or bar codes. Portions of the header area of the bag bay be perforated to allow them to be detached as receipts.

If the heat-sensitive ink were capable of adhering sufficiently firmly directly on to the material of the bag then the matt ink layer 8 could be omitted. The heat-sensitive ink could be incorporated intimately into one of the other layers, for example into the adhesive of layer 10. The heat-sensitive ink need not be patterned. The heat-sensitive ink could react to heat in other ways than by changing colour, for instance by blistering, fracturing or swelling. The cold-sensitive structure 16, 19 could be omitted. The heat-sensitive ink could be supplemented with or replaced by another heat-sensitive material. Analogous principles to those described above in relation to heat-sensitive inks may be employed using cold-sensitive inks to provide evidence of tampering at lowered rather than raised temperatures.

Figure 3:
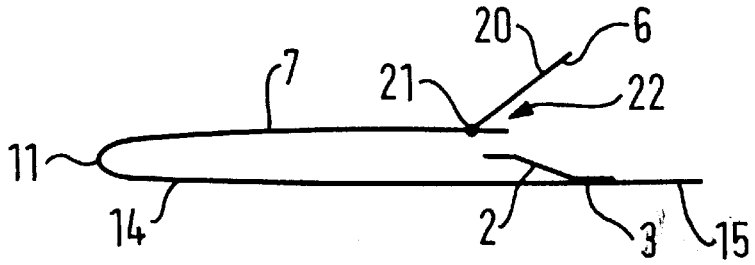
FIG. 3 shows a cross-section of an alternative embodiment of a security bag.

The bag shown in FIG. 3 employs the same security principles as the bag of FIG. 1. However, instead of the sealing region 6 being located on the upper surface 7 of the bag it is located on a secondary flap 20 that is welded to the upper surface of the bag by rim weld 21 which runs across the full width of the opening in the body of the bag. The front surface 7 of the bag is shorter than in the embodiment of FIG. 1 but may, if desired, overlap the flap 2 to some extent, as in the region 22 in FIG. 3 which extends beyond the rim weld 21. The secondary flap 20 carries the matt ink layer 8 and the heat-sensitive layer 9 on the surface that faces flap 2 and is located so as to meet the adhesive surface of flap 2 when the two are folded together to seal the bag shut. The adhesive surface of flap 2 is on the flap's upper surface as shown in FIG. 3. The flaps could be fixed in the opposite configuration, with the adhesive flap 2 joined to the body of the bag at rim weld 21 and the secondary flap 20 joined to the bag at header weld 3. One of the flaps could be fixed in place by an additional weld so that it was so longer hingeable relative to the body of the bag.

The embodiment of FIG. 3 has a number of additional advantages. First, there is no need to print heat-security inks on to the body of the bag. This means that the body of the bag can be printed in a more conventional process. The material of which the secondary flap 20 is formed may be chosen to be more suitable for receiving matt ink and/or heat-sensitive ink than the material of the body of the bag. The secondary flap 20 may be cut from a reel of tape that has been preprinted with heat-sensitive ink and then welded in place at the opening of the bag. The presence of two flaps widens the opening of the bag and makes it easier to insert items into the bag.

The principles of the seals described above may be applied to other articles than bags. Examples of other applications include security tape seals and fixings.

The applicant draws attention to the fact that the present invention may include. any feature or combination of features disclosed herein either implicitly or explicitly or any generalization thereof, without limitation to the scope of any of the present claims. In view of the foregoing description it will be evident to a person skilled in the art that various modifications may be made within the scope of the invention.

What is claimed is:

1. A tamper-evident seal comprising:

a first seal member having an adhesive surface region bearing adhesive;

a second seal member having a sealing surface region located for adhesion to the adhesive borne by the adhesive surface region;

at least one of the adhesive surface region and the sealing surface region being at least partially coated with a heat-sensitive layer so that when the adhesive surface region is adhered to the sealing surface region the heat-sensitive layer is sealed between the first seal member and the second seal member for providing evidence of thermal tampering;

the other of the adhesive surface region and the sealing surface region being at least partially coated with a cold-sensitive layer so that when the adhesive surface region is adhered to the sealing surface region the cold sensitive layer is sealed between the first seal member and the second seal member for providing evidence of thermal tampering.

2. A tamper-evident seal according to claim 1, wherein one of the adhesive surface region and the sealing surface region are light transmissive.

3. A tamper-evident seal according to claim 1, wherein the said at least one of the adhesive surface region and the sealing surface region that is at least partially coated with the heat-sensitive layer is at least partially coated with an absorbent layer beneath the heat-sensitive layer.

4. A tamper-evident seal according to claim 3, wherein at least one of the adhesive surface region and the sealing surface region exhibits a colour and wherein the absorbent layer is the same colour as the at least one of the adhesive surface region and the sealing surface region on which it is at least partially coated.

5. A tamper-evident seal according to claim 1, wherein the heat-sensitive layer is in the form of a pattern or symbols.

6. A tamper-evident seal according to claim 1 wherein at least one of the adhesive surface region and the sealing surface region exhibits a colour and wherein the heat-sensitive layer is the same colour as the at least one of the adhesive surface region and the sealing surface region on which it is at least partially coated.

7. A tamper-evident seal according to claim 1 wherein the adhesive surface region includes an adhesive layer and wherein the evidence of thermal tampering is provided by at least one of a change in the heat-sensitive layer which occurs at a lower temperature than the temperature at which the adhesive layer thermally deteriorates under heating and a change in the cold sensitive layer which occurs at a higher temperature than the temperature at which the adhesive or the seal members thermally deteriorate under cooling.

8. A tamper-evident seal according to claim 1, wherein the evidence of thermal tampering is at least one of a colour change in the heat-sensitive layer, and an adhering of at least some of the layer of ink to the one of the adhesive surface region and the sealing surface region that is at least partially coated with the cold-sensitive layer.

9. A tamper-evident seal according to claim 1, wherein the adhesive surface region is hot melt glue.

10. A tamper-evident seal according to claim 1, wherein at least one of the adhesive surface region and the sealing surface region is at least partially coated with a cold-sensitive layer so that when the adhesive surface region is adhered to the sealing surface region the cold-sensitive layer is sealed between the first seal member and the second seal member for providing evidence of thermal tampering.

11. A bag comprising the tamper-evident seal of claim 1.

12. A bag according to claim 11 wherein one of the first and second members is a flap disposed at the opening of the bag.

13. A bag according to claim 11, wherein at least one of the members is made of plastics material.

14. A tamper-evident seal according to claim 1, wherein the at least one of the adhesive surface region and the sealing surface region that is at least partially coated with the heat-sensitive layer is at least partially coated with a layer of ink over the heat-sensitive layer.

15. A tamper-evident seal according to claim 1, wherein the heat-sensitive layer is in the form of patterns or symbols.

16. A tamper-evident seal according to claim 15, wherein the layer of ink is a different colour from the at least one of the adhesive surface region and the sealing surface region.

17. A tamper-evident seal comprising:

a first seal member having an adhesive surface region on a flap bonded to a header area of a bag adjacent an opening into the bag;

a second seal member having a sealing surface region on a secondary flap bonded to an upper layer of the bag located for adhesion to the adhesive surface region;

at least one of the adhesive surface region and the sealing surface region being at least partially coated with a heat-sensitive layer so that when the adhesive surface region is adhered to the sealing surface region the heat-sensitive layer is sealed between the first seal member and the second seal member for providing evidence of thermal tampering.

18. A bag comprising:

a first sheet member and a second sheet member together defining a bag opening therebetween;

a flap bonded to the first sheet member at the opening;

a flap engagement member bonded to the second sheet member at the opening; and a security seal comprising a tamper-evident temperature-sensitive structure borne by the flap or the engagement member and an adhesive structure borne by the other of the flap and the engagement member for adhering the flap to the flap engagement member to close the opening.

19. A bag as claimed in claim 18, wherein the flap engagement member is a flexible sheet.

20. A bag as claimed in claim 18, wherein the flap is welded to the first sheet member.

21. A bag as claimed in claim 18, wherein the flap engagement member is welded to the second sheet member.

22. A bag as claimed in claim 18, wherein the first sheet member is bonded to the second sheet member to define the bag opening.

23. A bag as claimed in claim 18, wherein the one of the flap and the engagement member that bears the tamper-evident temperature-sensitive structure is of a different material from the one of the first and second members to which it is bonded.

24. A bag as claimed in claim 18, wherein the flap engagement member is in the form of a flap.

25. A method for forming a bag comprising:

folding a first sheet member over a second sheet member to define a bag body with a bag opening therebetween;

providing a first seal body bearing an adhesive structure;

providing a second seal body bearing a tamper-evident temperature-sensitive structure;

bonding one of the first and second seal bodies to the first sheet member at the opening to form a flap; and bonding the other of the first and second seal bodies to the second sheet member at the opening so that the first seal body and the second seal body adhere together to close the opening.

* * * * *